United States Patent [19]

Williams, Jr.

[11] Patent Number: 4,541,606

[45] Date of Patent: Sep. 17, 1985

[54] RAM-TYPE BLOWOUT PREVENTER

[75] Inventor: Leonard E. Williams, Jr., Houston, Tex.

[73] Assignee: Cameron Iron Works, Inc., Houston, Tex.

[21] Appl. No.: 439,195

[22] Filed: Nov. 4, 1982

[51] Int. Cl.[4] ..... E21B 33/06

[52] U.S. Cl. ..... 251/1.3; 308/3 R

[58] Field of Search ..... 251/1 R, 1 A; 308/244, 308/3 R, 3 A, 3 C; 384/261, 247; 411/371, 373, 377, 908; 92/126, DIG. 1, 255, 178

[56] References Cited

U.S. PATENT DOCUMENTS

| | | | |
|---|---|---|---|
| 500,297 | 6/1893 | Reilly | 92/126 |
| 1,009,376 | 11/1911 | Bayles | 308/3 R |
| 2,702,510 | 2/1955 | Dourte | 92/126 X |
| 3,102,709 | 9/1963 | Allen | 251/1 A |
| 3,885,837 | 5/1975 | Mellor | 308/3 R |

*Primary Examiner*—Samuel Scott
*Assistant Examiner*—Allen J. Flanigan
*Attorney, Agent, or Firm*—Vinson & Elkins

[57] ABSTRACT

A ram-type blowout preventer including a body with a central bore and guideways extending outward therefrom, a ram in each guideway with means for moving it inward and outward and means for compensating for wear of the guideway or ram including at least one skid secured to the lower surface of the ram.

22 Claims, 9 Drawing Figures

RAM-TYPE BLOWOUT PREVENTER

BACKGROUND

Ram-type blowout preventers are used to close the upper end of a well bore to maintain the well under control whenever there is danger of a blowout. The rams move in guideways in the body of the blowout preventer and when closed are positioned to seal across the bore through the body with a ram front packer. To make the seal complete a sealing element is provided between the ram and the ram guideways, usually across the top and side of the ram extending from the ram front packer. The operation of the rams causes wear particularly in the lower surface of the guideway, and excessive wear can reposition the ram so that a leak can occur across the ram top sealing element.

U.S. Pat. No. 3,692,316 discloses a ram-type blowout preventer with keys secured to the underside of the rams sliding in slots in the bottom of the guideways to maintain the rams in proper alignment but there is no suggestion of compensating for wear.

U.S. Pat. No. 1,970,964 discloses a well flow stopper which includes a plate that is moved across the bore and includes an upper packer and a pair of lower springs to support the plate and urge it upward with the aid of pressure to sealed position. U.S. Pat. No. 1,981,279 discloses a ram type blowout preventer including a spring-pressed ring to hold the rams against the upper seat. The use of springs as shown in these two patents would not be effective to compensate for excessive wear in guideways and/or ram lower surface, particularly when the string passing therethrough is hung in tension on the ram.

SUMMARY

The present invention relates to a ram-type blowout preventer having a body with a central bore and guideways extending outwardly therefrom with rams movable therein and with means to compensate for wear in the ram guideways or in the ram to ensure that the ram seals are held against the upper interior surface of the guideways.

An object of the present invention is to provide an improved ram-type blowout preventer which ensures the ram top and side seals are effective independent of wear of the rams and guideways.

Another object of this invention is to provide an improved ram type blowout preventer which does not require shop repair with welding and subsequent machining to correct and compensate for excessive ram and/or guideway wear.

Still another object of this invention is to provide an improved ram type blowout preventer which can be quickly repaired to compensate for excessive wear of the ram guideways and the rams.

BRIEF DESCRIPTION OF THE DRAWINGS

These and other objects and advantages are hereinafter set forth and explained with reference to the drawings wherein.

DESCRIPTION OF THE PREFERRED EMBODIMENTS

Figure 1:
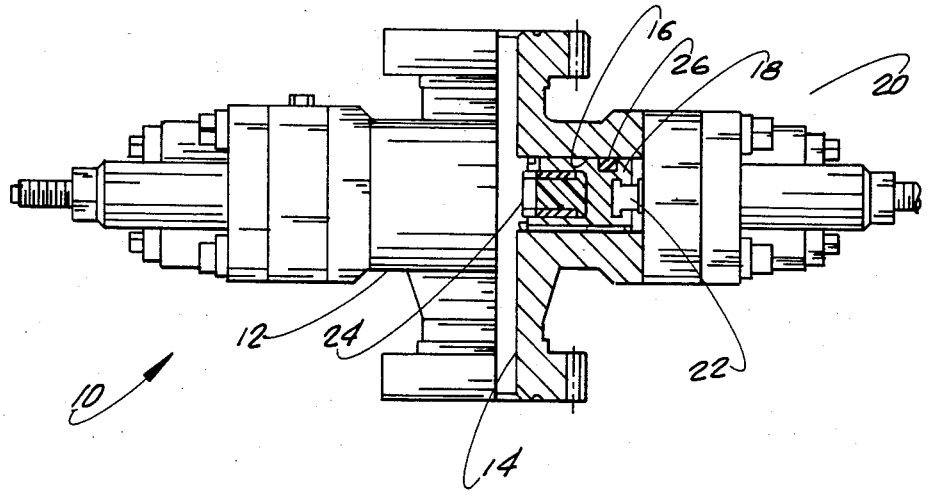
FIG. 1 is an elevation view (partly in section) of the improved blowout preventer of the present invention.
Figure 2:
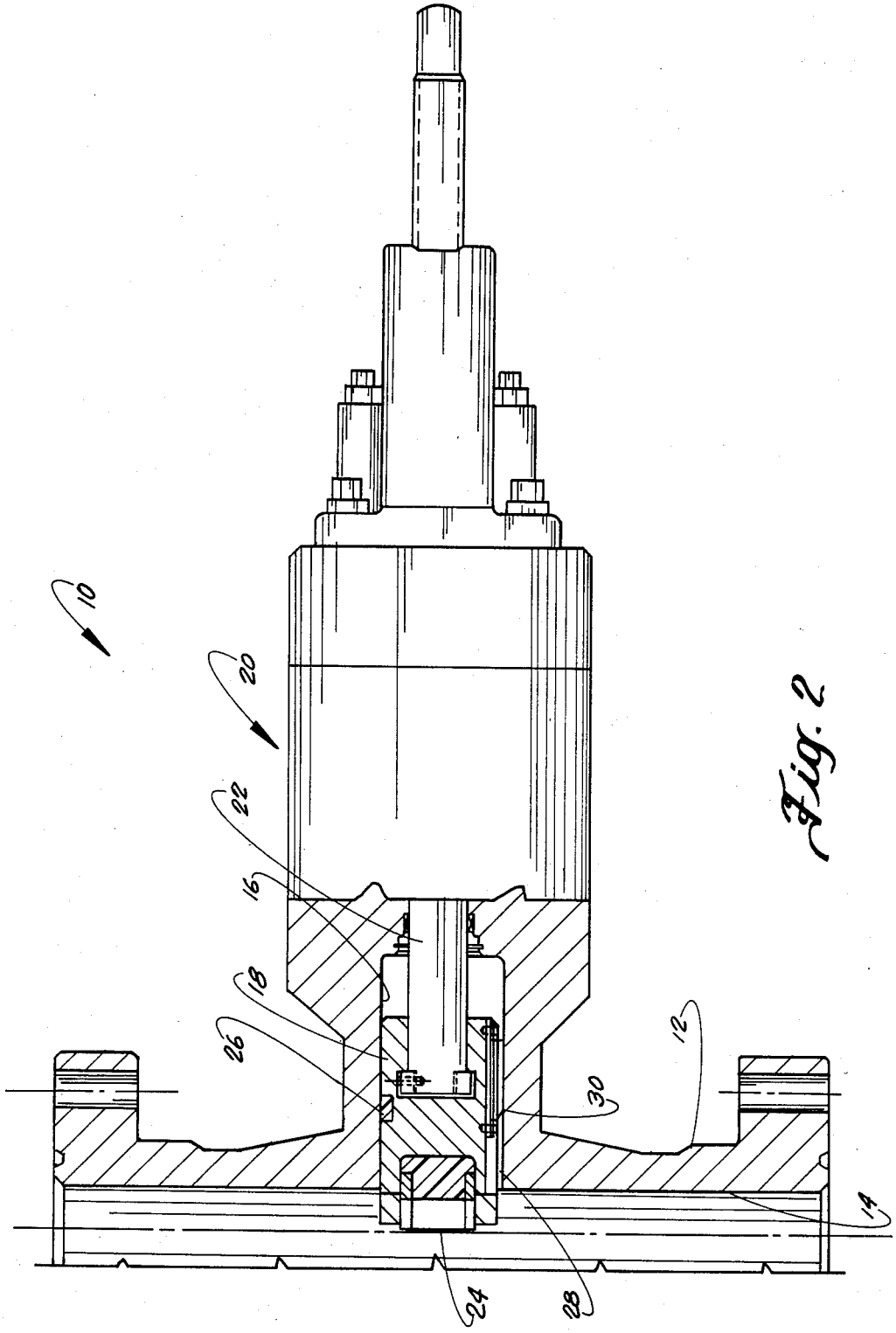
FIG. 2 is a partial sectional and elevation view of a portion of the improved blowout preventer of the present invention.

In FIG. 1, blowout preventer 10 is shown having body 12 through which central bore 14 extends with opposed aligned guideways 16 extending outward from bore 14. Ram 18 is moved in guideway 16 by suitable actuator 20 connected to ram 18 by connector rod 22. Ram 18 includes the usual ram front packer 24 and sealing element 26 which extends along the sides and across the top of ram 18 and seals against the interior of guideway 16.

Figure 3:
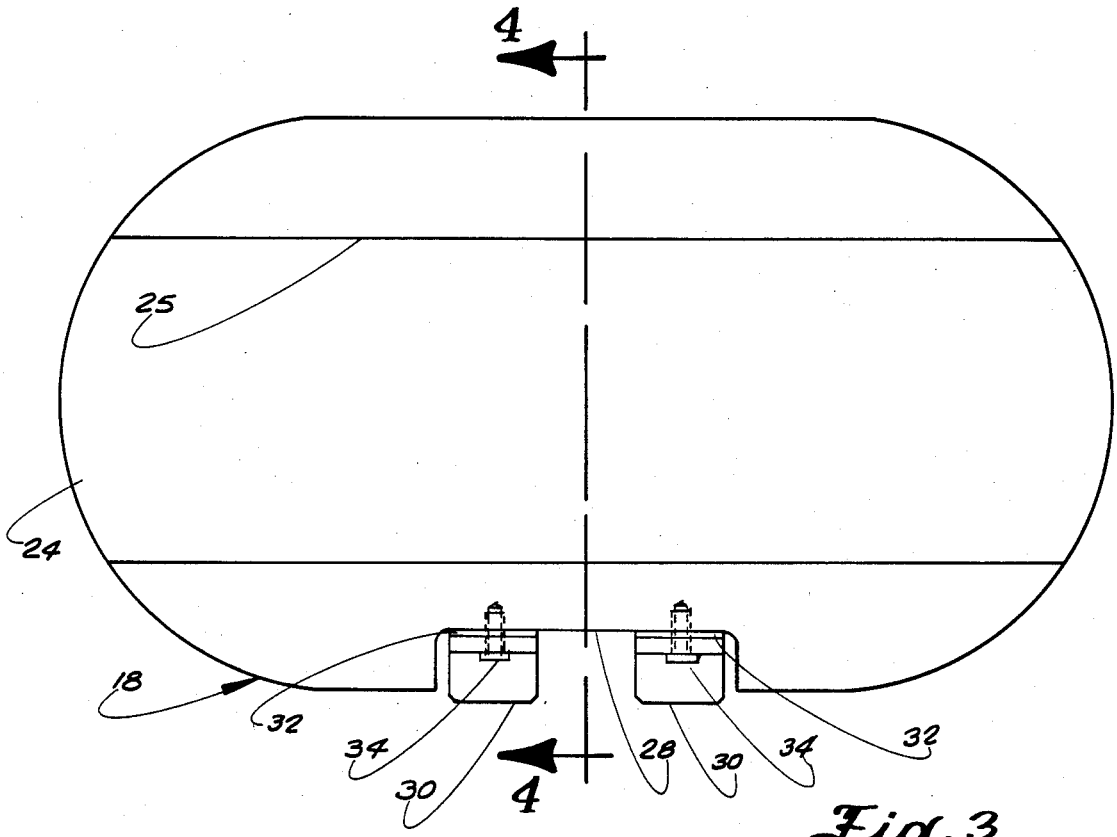
FIG. 3 is an end elevation view of one form of improved ram of the present invention.
Figure 4:
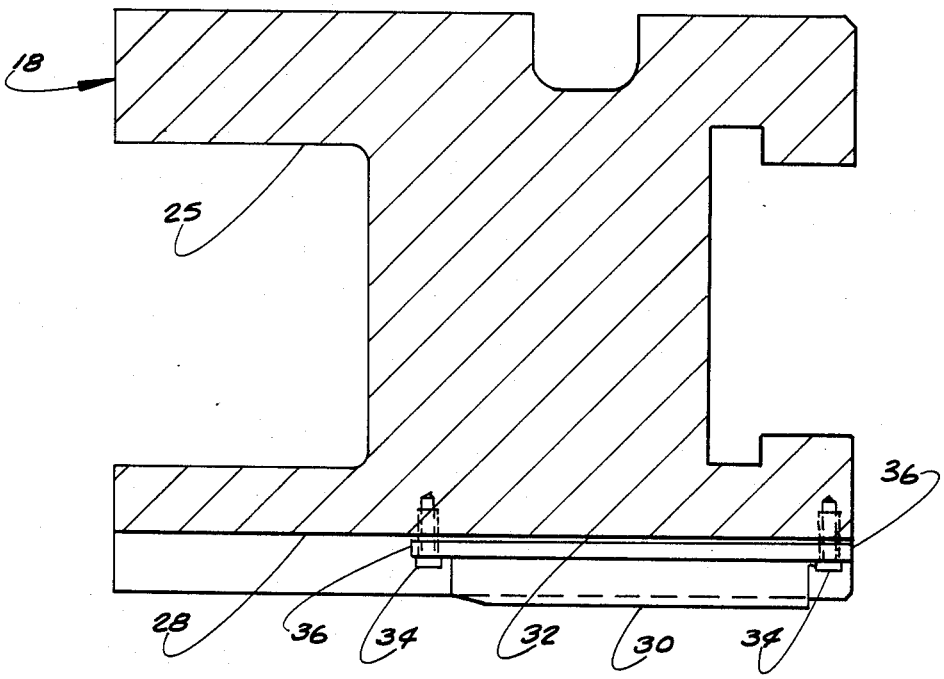
FIG. 4 is a sectional view taken along line 4—4 in FIG. 3.

The ram 18 shown in FIGS. 3 and 4 has the front packer slot 25 and a lower mud slot 28. Skids 30 and shims 32 are mounted in mud slot 28 by cap screws 34 which extend through end flanges 36 and shims 32. With different thicknesses of shims 32 or the use of multiple shims 32 compensation is provided for the wear of the lower surface of guideways 16 or the surface of skids 30 to ensure that sealing elements 26 are maintained in sealing engagement with the upper interior of guideways 16.

Figure 5:
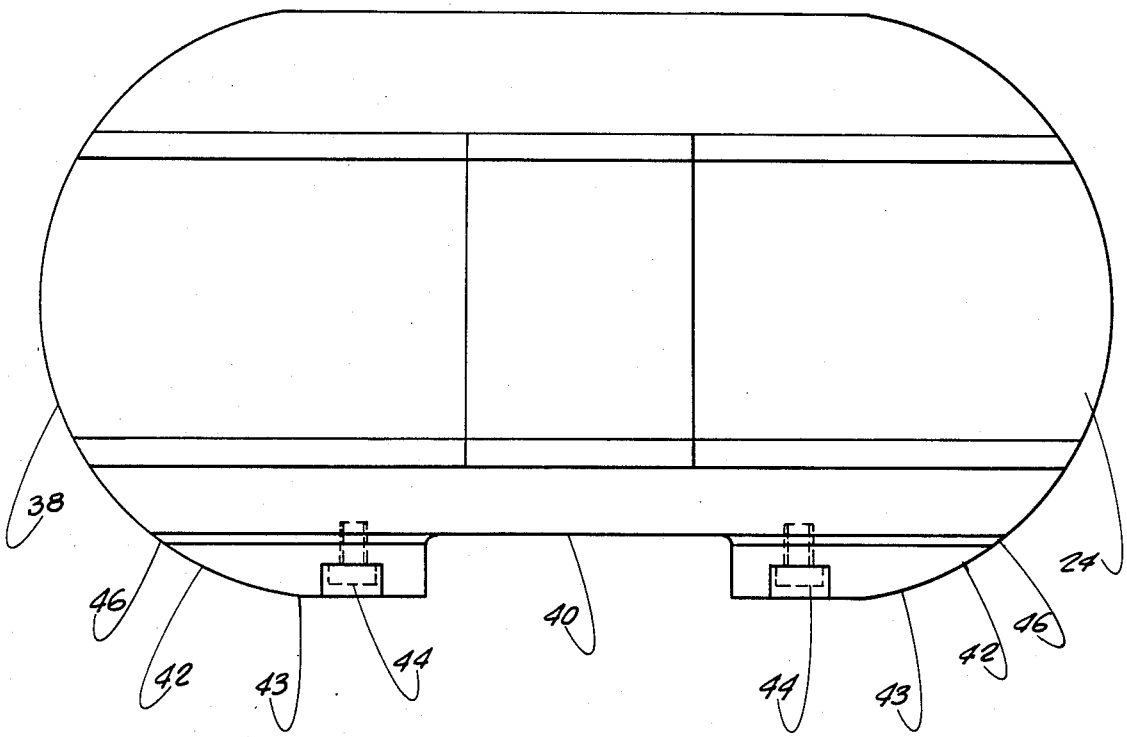
FIG. 5 is a view of the front of another form of improved ram of the present invention.

Another form of the improved blowout preventer ram of the present invention is shown in FIG. 5 as ram 38 which has the usual mud slot 40 extending from front to rear on its lower side but formed by skids 42 secured to its lower side. Skids 42 are shaped to conform to the shape of the guieways in which they are to be used and are secured to ram 38 by suitable fastening means, such as cap screws 44, with at least two or more being used to secure each of skids 42. As with the previously described form, shims 46 are positioned between skids 42 and the lower side of ram 38. With different thicknesses of shims 46 or with the use of multiple shims 46, skids 42 can be adjusted to compensate for wear of the guideways or of skid surfaces 43, and to ensure that its top and side sealing element are properly positioned for sealing.

Figure 6:
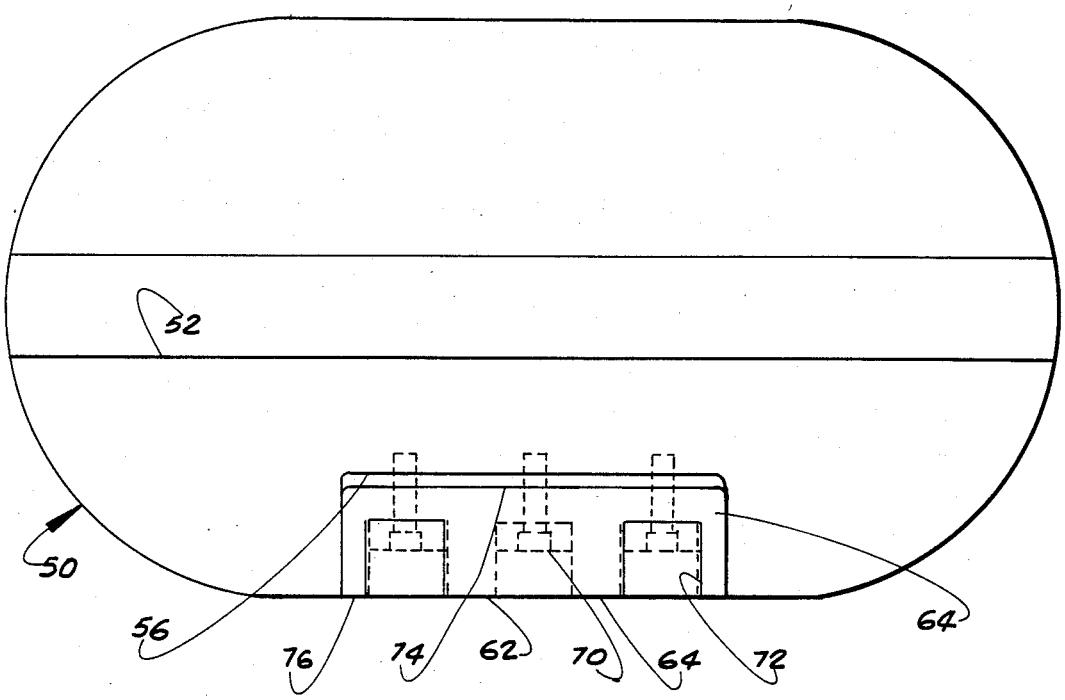
FIG. 6 is a view of the rear of a modified form of improved ram of the present invention.
Figure 7:
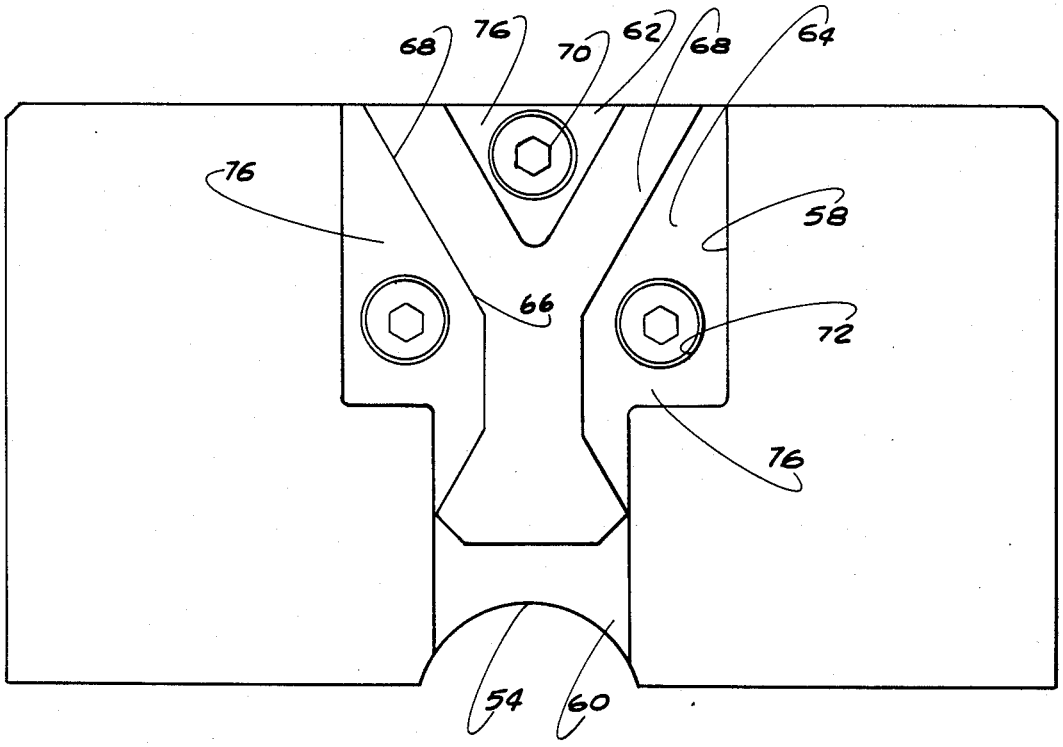
FIG. 7 is a bottom view of the ram shown in FIG. 6.
Figure 8:
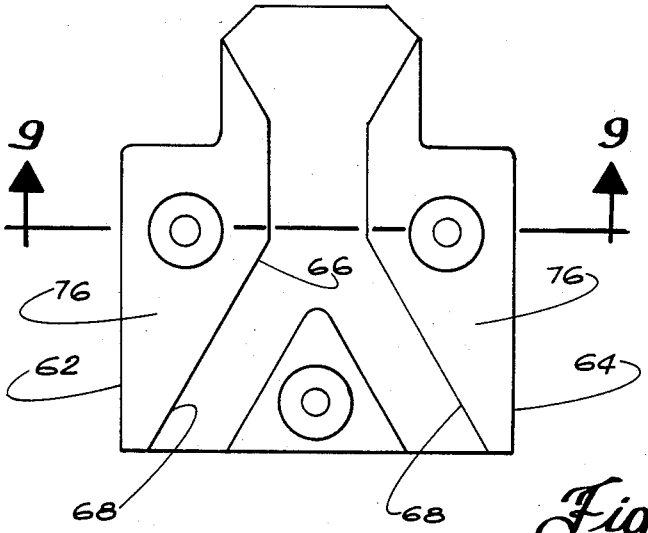
FIG. 8 is a bottom view of the insert skid used on the ram shown in FIGS. 6 and 7.
Figure 9:
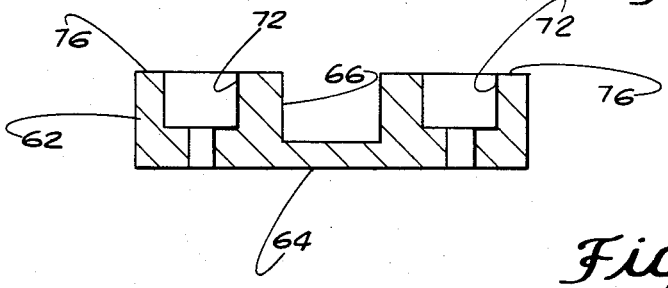
FIG. 9 is a sectional view of the insert skid taken along line 9—9.

Another form of the present invention is shown in FIGS. 6 and 7 as ram 50. Ram 50 has an exterior shape to fit closely in the guideway in which it is to be installed. Slot 52 across the rear of ram 50 is provided for the attachment of the connecting rod (not shown). Recess 54 on the front face of ram 50 is provided to receive tubular members therein.

Mud slot 56 on the lower surface of ram 50 includes rear recess 58 and forward slot 60 which is narrower than recess 58 as shown in FIG. 7. Skid 62 is positioned in recess 58 and extends into slot 60. Skid 62 includes body 64 with Y-shaped slot 66 extending therethrough as shown with the double slots 68 opening on the rear. Skid 62 is secured to ram 50 by screws 70 which are positioned in recesses 72. The heads of screws 70 are positioned wholly within recesses 72 so that they never engage the guideway in which ram 50 is positioned. To adjust for wear one or more shims 74 is positioned in slot 56. Skid 62 provides a pair of side skid surfaces 76 and triangular skid surface 78.

It is suggested that screws 34, 44 and 70 be made of a high strength non-galling material such as the thermoplastic polyester sold by E. I. du Pont de Nemours under the trademark "RYNITE" or the nylon sold by the same company under the trademark "ZYTEL", to avoid scarring of guideways 16 in the event a screw works loose. An alternate structure for preventing galling damage from a loose fastener would be to cap the head of the fastener with a non-galling material, such as a polytetrafluoroethylene so that if it becomes loose the head will readily slide with the movement of the ram and will not scar the guideway.

What is claimed is:

1. A ram-type blowout preventer comprising
a body having a central bore extending therethrough and opposed aligned ram guideways extending outward from said central bore,
a ram in each guideway and having a lower surface,
means for moving said rams into bore closing position and to retracted position out of said bore, and
non-resilient means of each of said rams to compensate for wear of said guideways and maintain said rams in their desired position in their guideways.

2. A ram-type blowout preventer according to claim 1 wherein said wear compensating means includes
at least one skid secured to the lower surface of said ram, and
at least one shim positioned between the skid and the ram.

3. A ram-type blowout preventer according to claim 2 including
two skids secured to the lower surface of said ram.

4. A ram-type blowout preventer according to claim 3 wherein
said ram includes a lower mud slot, and
said skids are mounted in said mud slot.

5. A ram-type blowout preventer according to claim 3 wherein
said skids are mounted to the lower ram surface at each side thereof and define a mud slot therebetween.

6. A ram-type blowout preventer according to claim 1 wherein said wear compensating means includes
a skid secured to the lower surface of the ram and being adjustable in position to compensate for wear.

7. A ram-type blowout preventer according to claim 6 wherein said skid includes
a body having a Y-shaped recess on the lower surface.

8. A ram-type blowout preventer according to claim 7 wherein said position adjustment includes
at least one shim positioned between the skid and the ram.

9. A ram-type blowout preventer according to claim 1 wherein said wear compensating means includes
fastening means for securing said wear compensating means to said rams,
said fastening means being of a non-galling material.

10. A ram-type blowout preventer according to claim 1 wherein said wear compensating means includes
fastening means for securing said wear compensating means to said rams, and
means covering the head of said fastening means with a non-galling material.

11. An improved ram structure for use in a ram-type blowout preventer having a central bore and guideways extending therefrom comprising
a ram body having a transverse shape conforming to the shape of its guideway, a lower surface, a front recess for receiving front packing and means for connecting to an actuator, and
means on the lower surface of the ram body to compensate for wear of its guideway.

12. An improved ram structure according to claim 11 wherein said wear compensating means includes
at least one skid secured to the lower surface of said ram, and
at least one shim positioned between the skid and the ram.

13. An improved ram structure according to claim 12 including
two skids secured to the lower surface of said ram.

14. An improved ram structure according to claim 13 wherein
said ram includes a lower mud slot, and
said skids are mounted in said mud slot.

15. An improved ram structure according to claim 13 wherein
said skids are mounted to the lower surface at each side thereof and define a mud slot therebetween.

16. An improved ram structure according to claim 11 wherein said wear compensating means includes
a skid secured to the lower surface of the ram and being adjustable in position to compensate for wear.

17. An improved ram structure according to claim 11 wherein said wear compensating means includes
a skid having a Y-shaped recess on its lower surface with the two channels of the recess facing the rear of the ram.

18. A ram-type blowout preventer comprising
a body having a central bore extending therethrough and opposed aligned ram guideway extending outward from said central bore,
a ram in each guideway and having a mud slot in its lower side,
means for moving said rams into bore closing position and to retracted position out of said bore,
two skids secured to the lower surface of said ram in said mud slot, and
at least one shim positioned between each skid and the ram.

19. A ram-type blowout preventer comprising
a body having a central bore extending therethrough and opposed aligned ram guideways extending outward from said central bore,
a ram in each guideways and having a lower surface,
means for moving said rams into bore closing position and to retracted position out of said bore,
two skids secured to the lower surface of said ram and being spaced apart to form a mud slot, and
at least one shim positioned between each skid and the ram.

20. A ram-type blowout preventer comprising
a body having a central bore extending therethrough and opposed aligned ram guideways extending outward from said central bore,
a ram in each guideway,
means for moving said rams into bore closing position and to retracted position out of said bore, and
means removably secured to each ram to maintain the rams in position in their guideways with their guideway seals in sealing engagement with the interior of their guideways.

21. A ram-type blowout preventer comprising a body having a central bore extending therethrough and opposed aligned ram guideways extending outward from said central bore, a ram in each guideway, means for moving said rams into bore closing position and to retracted position out of said bore, and replaceable means on each of said rams to compensate for wear of said guideways or rams and maintains said rams in their desired position in their guideways.

22. A ram-type blowout preventer comprising a body having a central bore extending therethrough and opposed aligned ram guideways extending outward from said central bore, a ram in each guideway, means for moving said rams into bore closing position and to retracted position out of said bore, and at least one replaceable wear skid secured to each of said rams to maintain the rams in position in their guideways with their guideway seals sealing against the interior of their guideways.

* * * * *

UNITED STATES PATENT AND TRADEMARK OFFICE

CERTIFICATE OF CORRECTION

PATENT NO. : 4,541,606

DATED : September 17, 1985

INVENTOR(S) : Leonard E. Williams, Jr.

It is certified that error appears in the above—identified patent and that said Letters Patent is hereby corrected as shown below:

Column 3, line 24, change "of" to -- on --;(1st occurrence)

Column 4, lines 51 and 53, change "guideways" to -- guideway --.

Signed and Sealed this

*Eleventh* Day of *February 1986*

[SEAL]

*Attest:*

DONALD J. QUIGG

*Attesting Officer*

*Commissioner of Patents and Trademarks*